United States Patent [19]

Sano et al.

[11] Patent Number: 4,725,315

[45] Date of Patent: Feb. 16, 1988

[54] DESENSITIZER COMPOSITION FOR COLOR DEVELOPER SHEET IN PRESSURE SENSITIVE RECORDING SYSTEM CONTAINS A PIPERIDINE DERIVATIVE

[75] Inventors: Shojiro Sano; Keiso Saeki, both of Shizuoka, Japan

[73] Assignee: Fuji Photo Film Co., Ltd., Kanagawa, Japan

[21] Appl. No.: 869,769

[22] Filed: Jun. 2, 1986

[30] Foreign Application Priority Data

May 31, 1985 [JP] Japan ..... 60-117916

[51] Int. Cl.[4] ..... B41M 5/22

[52] U.S. Cl. ..... 106/20; 106/21; 427/150

[58] Field of Search ..... 106/21, 20; 346/221; 427/150

[56] References Cited

U.S. PATENT DOCUMENTS

| | | | |
|---|---|---|---|
| 2,777,780 | 1/1957 | Cormack et al. | 427/150 |
| 3,640,928 | 2/1972 | Murayama et al. | 524/99 |
| 3,890,156 | 6/1975 | Matsukawa et al. | 106/19 |
| 3,931,430 | 1/1976 | Tada et al. | 427/150 |
| 3,952,117 | 4/1976 | Miyamoto | 427/150 |
| 4,012,538 | 3/1977 | Miyamoto et al. | 427/145 |
| 4,022,624 | 5/1977 | Miyamoto et al. | 106/2 |
| 4,101,690 | 7/1978 | Miyamoto et al. | 427/150 |
| 4,337,280 | 6/1982 | Miyamoto et al. | 427/150 |

FOREIGN PATENT DOCUMENTS

| | | |
|---|---|---|
| 2145641 | 3/1972 | Fed. Rep. of Germany . |
| 2526592 | 1/1976 | Fed. Rep. of Germany . |
| 46-029546 | 8/1971 | Japan . |

OTHER PUBLICATIONS

Journal of Polymer Science, Polymer Chemical Edition, 1984, 22, pp. 277–281.

*Primary Examiner*—A. Lionel Clingman
*Attorney, Agent, or Firm*—Sughrue, Mion, Zinn, Macpeak & Seas

[57] ABSTRACT

A desensitizer composition is described, comprising a desensitizer, a 2,2,6,6-tetramethylpiperidine derivative, and additives.

6 Claims, No Drawings

DESENSITIZER COMPOSITION FOR COLOR DEVELOPER SHEET IN PRESSURE SENSITIVE RECORDING SYSTEM CONTAINS A PIPERIDINE DERIVATIVE

FIELD OF THE INVENTION

The present invention relates to a desensitizer composition, and more particularly to a desensitizer composition useful in pressure-sensitive copying paper with a view to reducing or eliminating the ability of a color developer to produce a color by reaction with a colorless color former.

BACKGROUND OF THE INVENTION

It has been known for many years that a color image can be produced by means of reaction involving contact between an electron-donating or proton-accepting colorless organic compound (hereinafter referred to as a color former) and an electron-accepting or proton-releasing solid acid (hereinafter referred to as a color developer). This phenomenon is embodied in pressure-sensitive copying paper as described in U.S. Pat. Nos. 2,505,470, 2,505,489, 2,550,471, 2,548,366, 2,712,507, 2,730,456, 2,730,457, 3,418,250, and 3,672,935. A printing method has also been proposed that prepares a sheet coated with color developer and produces a color image on that sheet by supplying an ink containing a color former; this technique is disclosed in West German Patent Application (OLS) No. 1,939,962.

The color developer has the properties defined above and is selected from among clays, phenolic resins, and metal salts of aromatic carboxylic acids. Since these color developers are usually coated in a uniform thickness on the entire surface of a support, the non-image areas of the sheet of color developer are desensitized by printing or otherwise coating a composition containing an appropriate desensitizer.

Detailed descriptions of such desensitizers are set forth in U.S. Pat. Nos. 2,777,780, 3,890,156, 3,931,430, 3,952,117, 4,012,538, 4,022,624, and 4,101,690; West German Patent 2,526,592; West German Patent Application (OLS) Nos. 2,359,079 and 2,727,194; Belgian Patent No. 804,221; Japanese Patent Publication Nos. 29546/71, 23850/74, 14571/75, and 29365/75; and Japanese Patent Application (OPI) Nos. 125018/77 and 67291/81 (the term "OPI" as used herein means a "published unexamined Japanese Patent Application"). Specific examples of the desensitizer include dodecyl trimethylammonium chloride, dodecylamine, 2,4,4-trimethyl-2-oxazoline, xylenediamine, polyoxyethylene alkylamine, polyoxyethylene alkylether, polyoxyethylene alkylphenyl ether, polyethylene glycol, polypropylene glycol, glycidyl ether adducts of amines, etc.

These desensitizers, however, are not completely satisfactory in their desensitizing effects and their effectiveness is particularly low with respect to fluoran-based color formers such as 3,6-bis-diphenylaminofluoran and 3-diethylamino-7-dibenzylaminofluoran. If a color former is brought into contact with the sheet of color developer after it is coated with a desensitizer in the non-image areas, those areas initially seem to be completely desensitized, but if the sheet is exposed to light (particularly sunlight), it often occurs that a color image appears on the non-image areas. In order to avoid this problem, a very thick coating of the desensitizer must be formed on the sheet of color developer by printing, but then the printed surface dries so slowly that the printing speed cannot be increased to an industrially acceptable level.

In addition, if characters are written or printed with a color ink on the surface of the sheet of color developer that has been coated with an increased amount of desensitizer, the resulting ink image will tend to undergo extensive discoloration or may be blurred.

SUMMARY OF THE INVENTION

The primary object, therefore, of the present invention is to provide a desensitizer composition which exhibits desensitizing effects par excellence with respect to color formers, especially fluoran-based color formers.

This object of the present invention is attained by a desensitizing composition comprising a desensitizer, a 2,2,6,6-tetramethylpiperidine derivative, and additives.

The 2,2,6,6-tetramethylpiperidine derivative which can preferably be used in the present invention includes the compounds represented by formulae (I) to (X) below;

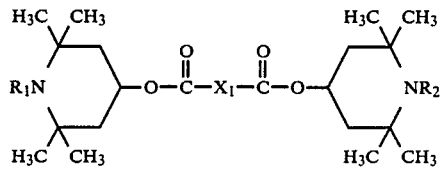

(I)

wherein $R_1$ and $R_2$ (which may be the same or different) each represents a hydrogen atom, an alkyl group having from 1 to 12 carbon atoms, an aryl group having from 6 to 12 carbon atoms or an aralkyl group having from 7 to 12 carbon atoms; and $X_1$ represents an alkylene group having from 1 to 18 carbon atoms (preferably from 6 to 10 carbon atoms);

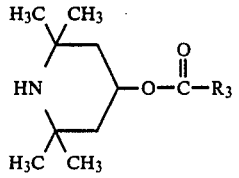

(II)

wherein $R_3$ represents an alkyl group having from 1 to 18 carbon atoms, an aryl group having from 6 to 12 carbon atoms or an aralkyl group having from 7 to 12 carbon atoms;

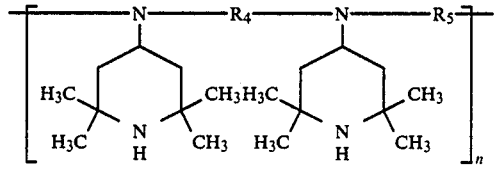

(III)

wherein $R_4$ and $R_5$ (which may be the same or different) each represents an alkylene group having from 1 to 12 carbon atoms; and n is an integer of from 2 to 10;

(IV)

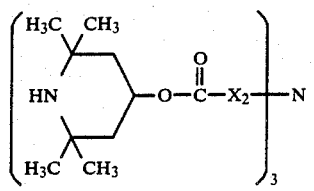

wherein $X_2$ represents an alkylene group having from 1 to 12 carbon atoms;

(V)

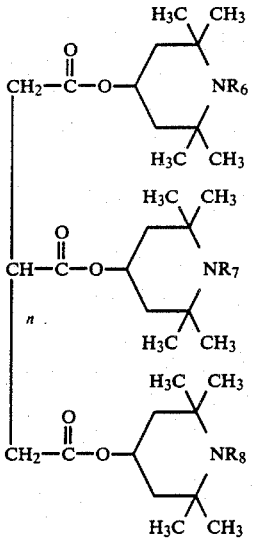

wherein $R_6$, $R_7$ and $R_8$ (which may be the same or different) each represents a hydrogen atom, an alkyl group having from 1 to 12 carbon atoms, an aryl group having from 6 to 12 carbon atoms or an aralkyl group having from 7 to 12 carbon atoms; and n is an integer of from 1 to 12;

(VI)

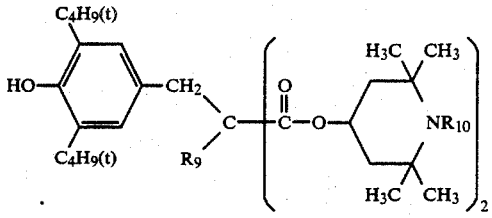

wherein $R_9$ represents an alkyl group having from 1 to 12 carbon atoms or a group represented by the following formula:

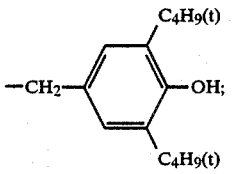

and $R_{10}$ represents a hydrogen atom, an alkyl group having from 1 to 12 carbon atoms or an acryloyl group;

(VII)

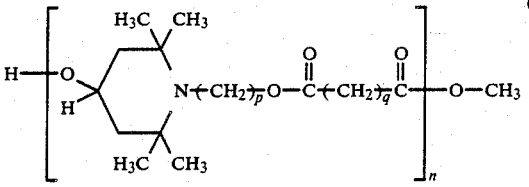

wherein p and q each is an integer of from 1 to 12; and n is an integer of from 2 to 50;

(VIII)

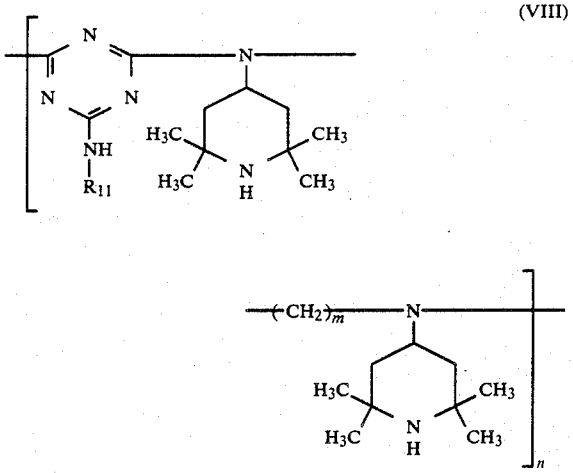

wherein $R_{11}$ represents a hydrogen atom, an alkyl group having from 1 to 18 carbon atoms, an aryl group having from 6 to 12 carbon atoms or an aralkyl group having from 7 to 12 carbon atoms; m is an integer of from 1 to 12; and n is an integer of from 2 to 10;

(IX)

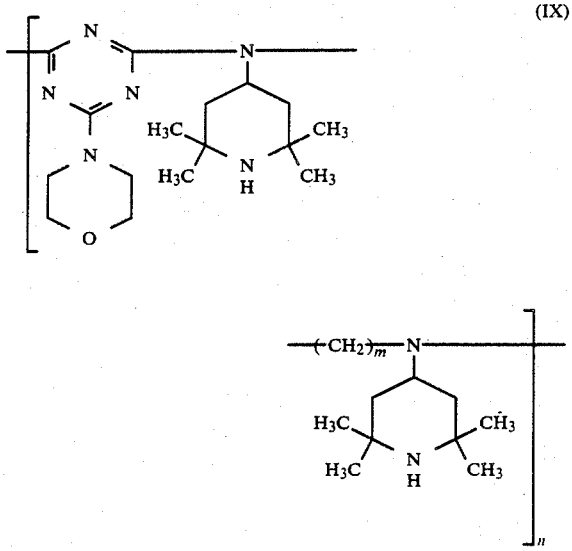

wherein m is an integer of from 1 to 12; and n is an integer of from 2 to 10; and

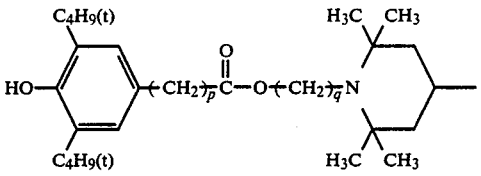

(X)

-continued

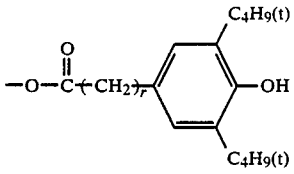

wherein p, q and r each is an integer of from 1 to 12.

Among these formulae, formulae (I), (V), (VI), (VIII) and (IX) are particularly preferable.

Specific examples of the 2,2,6,6-tetramethylpiperidine derivative used in accordance with the present invention are shown below, although the present invention is not to be construed as being limited thereto.

Compound I

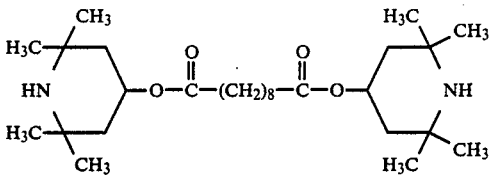

Compound II

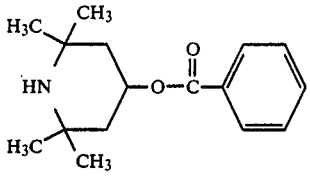

Compound III

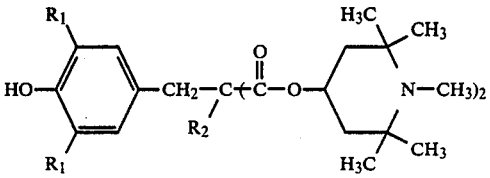

($R_1$: tert-butyl group, $R_2$: n-butyl group)

Compound IV

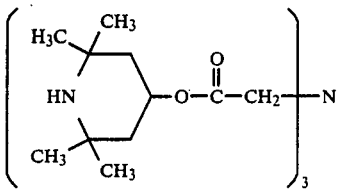

Compound V

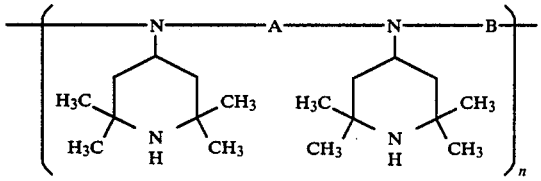

(A,B: alkylene group having from 1 to 12 carbon atoms; n: integer of 2–10)

Compound VI

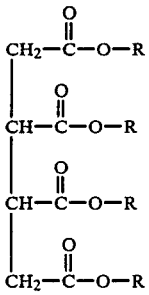

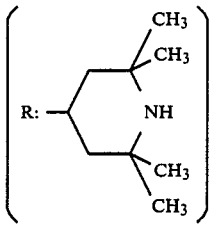

Compound VII

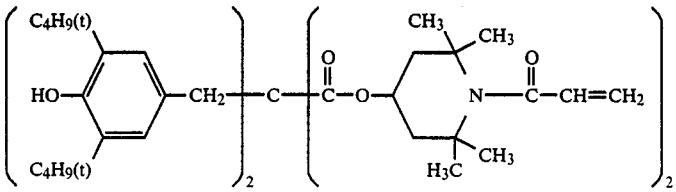

-continued

Compound VIII

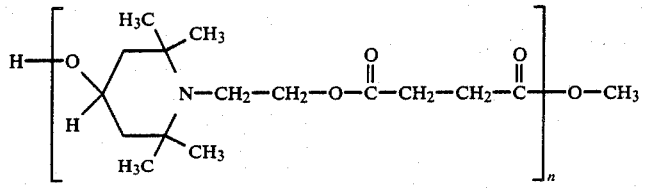

(n: integer of 2 to 20)

Compound IX

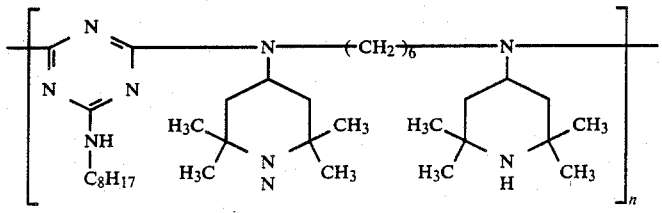

(n: integer of 2 to 10)

Compound X

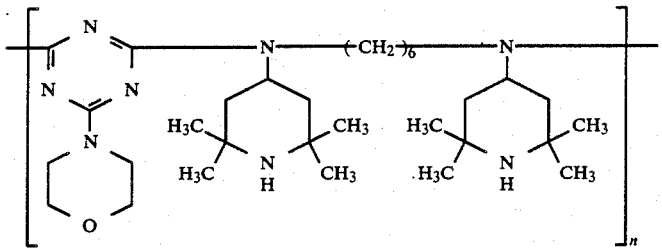

(n: integer of 2 to 10)

Compound XI

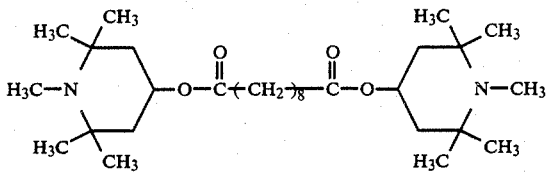

Compound XII

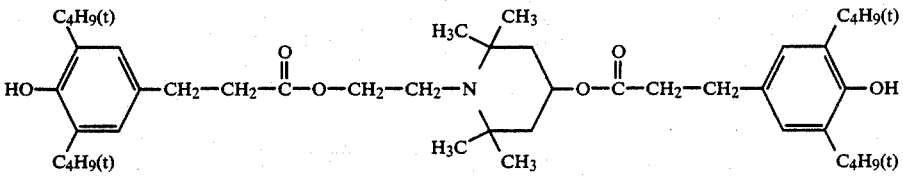

The 2,2,6,6-tetramethylpiperidine derivatives in accordance with the present invention may be used either independently or in combination and/or may be used in combination with ultraviolet absorbers such as those based on benzotriazole, salicylic acid, and benzophenone derivatives.

The compounds listed in above and other 2,2,6,6-tetramethylpiperidine derivatives are incorporated in the desensitizing composition of the present invention in an amount preferably ranging from 0.1% by weight (all percents indicated hereinafter are based on weight) to 40%, and more preferably from 1 to 20% (based on the total weight of the desensitizer composition).

Examples of the desensitizer contained in the desensitizer composition of the present invention include alkylamines alkylene oxide polymers, ammonia, monoamines, diamines, or polyamines having a polyoxyalkylene group, alkylethers, or arylethers having a polyoxyalkylene group, imidazole derivatives or bis-forms thereof, and cyclic amidine derivatives or bis-forms thereof.

Preferred desensitizers are set forth below:

aliphatic amines or diamines as described in U.S. Pat. No. 2,777,780;

polypropylene glycol as described in U.S. Pat. No. 3,952,117;

ammonia, monoamine, or diamine derivatives having a polyoxyethylene group as represented by formula (DI) or (DII)

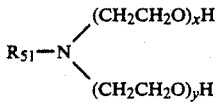

(DI)

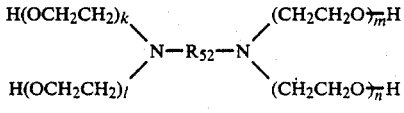

(DII)

where $R_{51}$ represents an alkyl group, an aryl group, or the group $(CH_2CH_2O)_zH$; $R_{52}$ represents an alkylene group; x+y is an integer of from 3 to 100; x+y+z is an integer of from 5 to 100; and k+l+m+n is an integer of from 8 to 200;

ammonia, monoamine, or diamine derivatives having a polyoxypropylene group as represented by formula (DIII) or (DIV)

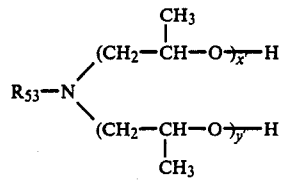

(DIII)

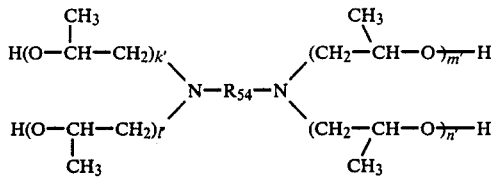

(DIV)

where $R_{53}$ represents an alkyl group, an aryl group, or the group

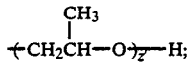

$R_{54}$ represents an alkylene group; x'+y' is an integer of from 3 to 100; x'+y'+z' is an integer of from 5 to 100; and k'+l'+m'+n' is an integer of from 8 to 200;

amine derivatives having a polyalkylene group that is described in Japanese Patent Application (OPI) No. 67291/81 and which is prepared by reacting an alkylene oxide containing 40 mol% butylene oxide with an amine compound represented by formula (DV)

$$R_{55}[NH(CH_2)_p]_qNH_2 \quad \text{(DV)}$$

where $R_{55}$ represents a hydrogen atom or an alkyl group; q if 0 or an integer of from 1 to 8; and p is an integer of from 1 to 12;

alkylene oxide adducts of alkylphenols as described in Japanese Patent Application (OPI) No. 125018/77, and the imidazole derivatives represented by formula (DVI) or bis-forms thereof

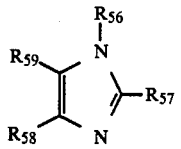

(DVI)

wherein $R_{56}$ represents a hydrogen atom, an alkyl group, or an aryl group; $R_{57}$ represents a hydrogen atom, an alkyl group, an aryl group, an amino group, or an alkylthio group; $R_{58}$ and $R_{59}$ each represents a hydrogen atom, an alkyl group such as a lower alkyl group like methyl, ethyl, etc., or an aryl group such as a phenyl group or a tolyl group; $R_{56}$ to $R_{59}$ may each have a substituent; and amidine derivatives represented by formula (DVII) or bis-forms thereof

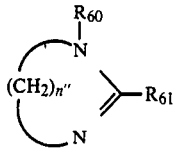

(DVII)

wherein $R_{60}$ represents a hydrogen atom, an alkyl group such as a lower alkyl group like methyl, ethyl, etc., or an aryl group such as a phenyl group or a tolyl goup; $R_{61}$ represents a hydrogen atom, an alkyl group such as a lower alkyl group like methyl, ethyl, etc., an aryl group such as a phenyl group or a tolyl group, an amino group, or an alkylthio group; n'' is an integer of from 2 to 6; $R_{60}$, $R_{61}$, and the ring-forming methylene group may each have a substituent.

Such desensitizers may be used either independently or in combination.

Additives incorporated in the desensitizer composition of the present invention are natural or synthetic high-molecular weight compounds such as ketone resins, polyamide resins, maleic acid resins, phenolic resins, epoxy resins, alkyd resins, melamine resins, urea resins, polyvinyl alcohol, gelatin, and shellac (phenolic resins such as rosin-modified phenolic resins, maleic resins such as rosin-modified maleic resins and ketone resins are desirable, and these compounds are typically incorporated as binder in the desensitizer composition in an amount of not more than 40 wt%, and preferably from 5 to 25 wt%), and pigments such as titanium dioxide, barium sulfate, calcium carbonate, talc, kaolin, bentonite, and organic bentonite (basic pigments such as titanium dioxide and calcium carbonate are desirable, and the aforementioned pigments are typically incorporated in the desensitizer composition in an amount of not more than 50 wt%, and preferably from 0.3 to 40 wt%).

Other various additives may be incorporated in the desensitizer composition of the present invention and they may be selected from among the ingredients of common printing inks which are described, e.g., in detail in Chapters 2 to 9 of E. A. Apps, *Printing Ink Technology,* Leonard Hill, London, 1961; illustrative additives are vegetable oils such as linseed oil, tung oil, soybean oil, and cottonseed oil, or heated polymers thereof (these oils or heated polymers thereof are typically incorporated in an amount of from 0 to 50 wt%, and preferably from 0 to 20 wt%, i.e., based on the total weight of the desensitizer composition); wax such as paraffin wax, microcrystalline wax, and carnauba wax (these are typically incorporated in an amount of from 0 to 10 wt%, and preferably from 0 to 5 wt%); and set-off preventing agents such as starch and dextrin (which are typically incorporated in an amount of from 0 to 10 wt%, and preferably from 0 to 5 wt%).

The desensitizer composition of the present invention may be readily prepared by those skilled in the art by mixing the ingredients described above, melting the mixture, and optionally kneading the melt with a three-roll mill, a kneader, etc. The resulting desensitizer composition is coated onto the sheet of color developer by printing with, for example, a letter-press, dry offset, or wet offset printing machine. The coating weight of the desensitizer composition typically ranges from 0.08 to 10.0 g/m$^2$, and preferably from 1.5 to 6.0 g/m$^2$.

Examples of the color developer with which the desensitizer composition of the present invention may be employed include clays (e.g., acid clay, activated clay, attapulgite, and kaolin), phenolic resins, and metal salts of aromatic carboxylic acid. The phenolic resins may be illustrated by phenol-aldehyde polymers (generally referred to as "novolak type" resins) and phenolacetylene polymers. Illustrative examples of the metal salts of aromatic carboxylic acids are shown in U.S. Pat. Nos. 3,864,146 and 3,983,292, and Japanese Patent Application (OPI) No. 120010/79. A useful example of the aromatic carboxylic acid in the metal salt has a hydroxyl group in the position ortho or para to the carboxyl group. A salicylic acid derivative is preferable, and a particularly preferable derivative is such that it has a substituent (e.g., alkyl, aryl, or aralkyl) in at least one of the positions which are ortho and para to the hydroxyl group, with the total of the carbon atoms in the substituents being at least 8. These aromatic carboxylic acids form metal salts with metals which are preferably selected from among zinc, tin, and aluminum, with zinc providing best results.

The color developers illustrated above are coated onto a support such as paper together with a binder such as a styrene-butadiene latex.

The desensitizer composition of the present invention is most effective when used with fluoran-based color formers which have presented considerable difficulty in desensitization but, needless to say, this composition may exhibit the intended function even if it is used with other types of color formers. Specific examples of the color formers that may advantageously be used with the desensitizer composition of the present invention are set forth below:

(1) fluoran-based compounds such as 3,6-bisdiphenylaminofluoran, 3-diphenylamino-6-ditolyaminofluoran, 3,6-bis(N-phenyl-N-tolyl-)aminofluoran, 3,6-bis(N-phenyl-N-anisyl)aminofluoran, 3,6-bis(N-p-chlorophenyl-N-phenyl-)aminofluran, 3-diphenylamino-6-(N-phenyl-N-isopropylphenyl)aminofluoran, 3-diethylamino-7-dibenzylaminofluoran, 3-diethylamino-7,8-benzofluoran, 3-diethylamino-6-methyl-7-anilinofluoran, 3-diethylamino-6-chloro-7-anilinofluoran, 3-dimethylamino-7-methoxyfluoran, 3-diethylamino-6-methoxyfluoran, and 3-N-cyclohexyl-N-methylamino-6-methyl-7-anilinofluoran;

(2) triarylmethane-based compounds such as 3,3-bis(p-dimethylaminophenyl)-6-dimethylaminophthalide, 3-bis-(1,2-dimethylindole-3-yl)-5-dimethylaminophthalide;

(3) diphenylmethane-based compounds such as bis(4-dimethylaminophenyl)-(p-toluenesulfonyl)methane and bis(4-dimethylaminophenyl)-benzenesulfonylmethane;

(4) thiazine-based compounds such as benzoyl-leucomethylene blue and p-nitrobenzoyl-leucomethylne blue; and (5) spiro compounds such as 3-methyl-spirodinaphthopyran and 3-propyl-spiro-dibenzopyran.

These color formers are coated onto a support after they are dissolved in solvents for capsule formation or dispersed in binder solutions. Natural or synthetic oils may be used as solvents either independently or n combination. More specific examples of the solvents include cottonseed oil, kerosene, paraffin, naphthenic oil, alkylated biphenyl, alkylated terphenyl, chlorinated paraffin, alkylated naphthalene and diarylethane. Capsules of color former may be prepared by using the coacervation of hydrophilic colloid sols as described in U.S. Pat. Nos. 2,800,457 and 2,800,458, and by the interfacial polymerization method described in British Pat. Nos. 867,797, 950,443, 989,264, and 1,091,076.

The present invention is be illustrated in greater detail with reference to the following examples, but it is to be understood that these examples do not limit the present invention. In these examples, all the percents, parts and ratios are by weight unless otherwise indicated.

EXAMPLE

The effectiveness of the desensitizer composition of the present invention was confirmed with a sheet of color developer and two sheets of color former that were prepared by the following procedures.

Preparation of Color Developer Sheet

Zinc oxide (2 parts), calcium carbonate (18 parts), and zinc 3,5-di-α-methylbenzylsalicylate (4 parts) were mixed in 70 parts of water. After dispersing the ingredients by treatment with an attritor for 30 minutes, a carboxyl-modified styrene-butadiene rubber (SBR) latex (2.5 parts in terms of solids content) and 12 parts of a 10 wt% aqueous solution of polyvinyl alcohol (PVA) (degree of saponification: 99%, and degree of polymerization: (1,000) were added to the dispersion, and the mixture was uniformly agitated to form a coating solution. This solution was coated onto a raw paper (50 g/m$^2$) with an air knife coater to provide a coat having a solids content of 4 g/m$^2$ and dried to obtain a color developer sheet.

Preparation of Color Former Sheet A

Ten parts of an acid-treated gelatin having an isoelectric point of 8.0 and 10 parts of gum arabic were dissolved in 60 parts of water at 40° C. To the solution, 0.2 part of sodium alkylbenzenesulfonate was added as an emulsifier and an emulsion was formed by addition of 50 parts of a color former oil. This color former oil was an oil that was composed of 1-phenyl-1-xylylethane (4 parts) and kerosene (1 part) and which had 3,6-bisdiphenylaminofluoran (4.0 wt%) dissolved therein.

When the emulsion globules grew to an average size of 6 microns, 100 parts of water (40° C.) was added to quench the progress of emulsification.

With continued agitation, an additional 210 parts of water (30° C.) was added, and the pH of the system was adjusted to 4.4 by addition of 20% HCl. With continued agitation, the solution was cooled to 8° C., followed by the addition of 1.5 parts of 20% glutaraldehyde.

Subsequently, 30 parts of a 10% solution of carboxymethylated starch was added thereto and the pH of the system was adjusted by dropwise addition of 25% sodium hydroxide. Thereafter, the solution was heated to 30° C., thereby producing microcapsules having hardened walls.

Ten parts of cellulose flocs were dispersed in the solution, which then was applied to paper (40 g/m$^2$) to provide a coat having a solids content of 6 g/m$^2$, and dried to obtain a color former sheet A.

Preparation of Color Former Sheet B

A color former oil was prepared by dissolving 6 wt% of 3-diethylamino-7-dibenzylaminofluoran and 3 wt% of 3-diethylamino-7,8-benzofluoran in 4 parts of diisopropylnaphthalene. Fifty parts of this oil was processed as in the preparation of Color Former Sheet A, thereby producing a Color Former Sheet B.

Model RD 514) so as to evaluate the desensitizing effect of each ink composition. The results are shown in Table 3. The four comparative samples had the features described in Table 2.

TABLE 1

| Example No. | Desensitizer | 2,2,6,6-Tetramethyl derivative Compound | Amount (wt %) |
|---|---|---|---|
| I-1 | $C_{18}H_{37}N$ (bonds to $(C_2H_4O)_8H$ and $(C_2H_4O)_8H$) | I | 10 |
| I-2 | same as in Example I-1 | II | 10 |
| I-3 | same as in Example I-1 | III | 10 |
| I-4 | same as in Example I-1 | IV | 10 |
| I-5 | same as in Example I-1 | V | 10 |
| I-6 | same as in Example I-1 | VI | 10 |
| I-7 | same as in Example I-1 | VII | 10 |
| II-1 | $N(CH_2)_2N$ with $H(OC_3H_6)_a$, $H(OC_3H_6)_b$, $(C_3H_6O)_cH$, $(C_3H_6O)_dH$; $a + b + c + d = 12$ | I | 5 |
| II-2 | same as in Example II-1 | III | 5 |
| II-3 | same as in Example II-1 | VI | 5 |
| III-1 | $N(CH_2)_2N$ with $H(OC_3H_6)_p(OC_2H_4)_{k'}$, $H(OC_3H_6)_q(OC_2H_4)_{l'}$, $(C_2H_4O)_{m'}(C_3H_6O)_rH$, $(C_2H_4O)_{n'}(C_3H_6O)_sH$; $p + q + r + s = 50$, $k' + l' + m' + n' = 10$ | I | 6 |
| III-2 | same as in Example III-1 | II | 6 |
| III-3 | same as in Example III-2 | VI | 6 |
| IV-1 | polypropylene glycol (av. Mw. 400) | I | 8 |
| IV-2 | same as in Example IV-1 | VI | 8 |
| V-1 | $N(CH_2)_2N(CH_2)_2N$ with $H(OC_4H_9)_e$, $H(OC_4H_9)_f$, $(C_4H_9O)_gH$, $(C_4H_9O)_hH$, $(C_4H_9O)_iH$; $e + f + g + h + i = 15$ | I | 5 |
| V-2 | same as in Example V-1 | VIII | 5 |
| V-3 | same as in Example V-1 | IX | 5 |
| V-4 | same as in Example V-1 | X | 5 |
| V-5 | same as in Example V-1 | XI | 5 |

Preparation of Desensitizing Inks

Fifteen parts of a rosin-modified maleic acid resin (softening point, 120° C.; and acid value, 150) was mixed with 50 parts of a selected desensitizer (see Table 1), and the mixture was melted by heating at 150° C. for 1 hour. To the melt, 35 parts of titanium dioxide was added and the mixture was kneaded with a three-roll mill, thereby forming a desensitizing ink base. To this ink base, a selected 2,2,6,6-tetramethylpiperidine derivative was added, thereby preparing a desensitizing ink composition.

Test Method

Each of the desensitizing ink composition was print-coated onto the color developer sheet to form a coat in a thickness of 4.0 g/m$^2$. The desensitized surface of each sample was superposed on color former sheet A or B and a load of 600 kg/cm$^2$ was applied to the assembly so as to effect color formation and development. After exposure to the sunlight for 2 hours, the reflection visual density (Vis. D) of the image formed on each of the samples was measured with a densitometer (Macbeth

TABLE 2

| Comparative Example No. | Remarks |
|---|---|
| I | Same as in Example I-1 except that no 2,2,6,6-tetramethylpiperdine derivative was present |
| II | Same as in Example II-1 except that no 2,2,6,6-tetramethylpiperidine derivative was present |
| III | Same as in Example III-1 except that no 2,2,6,6-tetramethylpiperidine derivative was present |
| IV | Same as in Example IV-1 except that no 2,2,6,6-tetramethylpiperidine derivative was present |
| V | Same as in Example V-1 except that no 2,2,6,6-tetramethylpiperdine derivative was present |

TABLE 3

| Run No. | Desensitizing Effect (Vis. D) Color Former Sheet A | Color Former Sheet B |
|---|---|---|
| Example | | |
| I-1 | 0.07 | 0.09 |
| I-2 | 0.08 | 0.09 |
| I-3 | 0.07 | 0.09 |
| I-4 | 0.07 | 0.09 |
| I-5 | 0.08 | 0.09 |
| I-6 | 0.07 | 0.09 |
| I-7 | 0.09 | 0.10 |
| Comparative Example I | 0.15 | 0.19 |
| Example | | |
| II-1 | 0.06 | 0.08 |
| II-2 | 0.07 | 0.08 |
| II-3 | 0.07 | 0.08 |
| Comparative Example II | 0.12 | 0.16 |
| Example | | |
| III-1 | 0.07 | 0.08 |
| III-2 | 0.07 | 0.08 |
| III-3 | 0.07 | 0.08 |
| Comparative Example III | 0.13 | 0.18 |
| Example | | |
| IV-1 | 0.08 | 0.09 |
| IV-2 | 0.08 | 0.09 |
| Comparative Example IV | 0.16 | 0.21 |
| Example | | |
| V-1 | 0.06 | 0.08 |
| V-2 | 0.08 | 0.09 |
| V-3 | 0.07 | 0.08 |
| V-4 | 0.07 | 0.08 |
| V-5 | 0.07 | 0.08 |
| Comparative Example V | 0.12 | 0.15 |

The advantages of the desensitizing compositions prepared in accordance with the present invention are obvious from Table 3, wherein the lower figures represent higher degrees of desensitizing effect. When none of the 2,2,6,6-tetramethylpiperidine derivatives specified by the present invention was present, a color image emerged from the desensitized surface as a result of exposure to the sunlight for 2 hours. However, the addition of one of the 2,2,6,6-tetramethylpiperidine derivatives enabled a substantially complete desensitization of the color developer sheet.

While the invention has been described in detail and with reference to specific embodiments thereof, it will be apparent to one skilled in the art that various changes and modifications can be made therein without departing from the spirit and scope thereof.

What is claimed is:

1. A desensitizer composition comprising a desensitizer, a 2,2,6,6-tetramethylpiperidine derivative selected compounds represented by formulae (I) to (X);

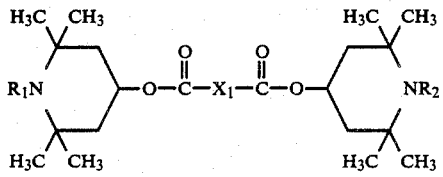

(I)

wherein $R_1$ and $R_2$ each represents a hydrogen atom, an alkyl group having from 1 to 12 carbon atoms, an aryl group having from 6 to 12 carbon atoms or an aralkyl group having from 7 to 12 carbon atoms; and $X_1$ represents a alkylene group having from 1 to 18 carbon atoms;

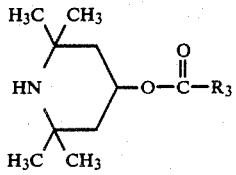

(II)

wherein $R_3$ represents an alkyl group having from 1 to 18 carbon atoms, an aryl group having from 6 to 12 carbon atoms or an aralkyl group having from 7 to 12 carbon atoms;

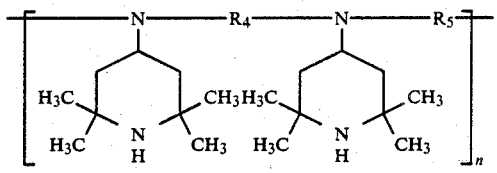

(III)

wherein $R_4$ and $R_5$ each represents an alkylene group having from 1 to 12 carbon atoms; and n is an integer of from 2 to 10;

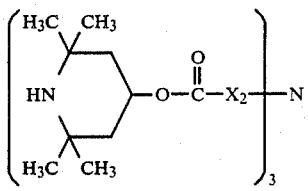

(IV)

wherein $X_2$ represents an alkylene group having from 1 to 12 carbon atoms;

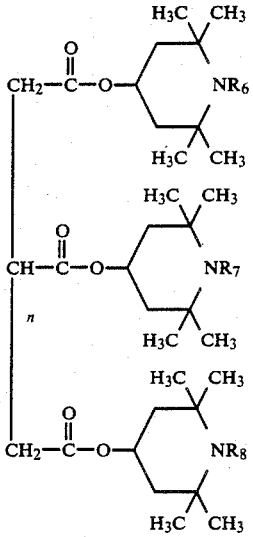

(V)

wherein $R_6$, $R_7$ and $R_8$ each represents a hydrogen atom, an alkyl group having from 1 to 12 carbon atoms, an aryl group having from 6 to 12 carbon atoms or an aralkyl group having from 7 to 12 carbon atoms; and n is an integer of from 1 to 12;

(VI)

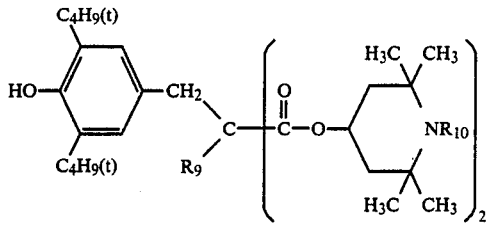

wherein $R_9$ represents an alkyl group having from 1 to 12 carbon atoms or a group represented by the following formula;

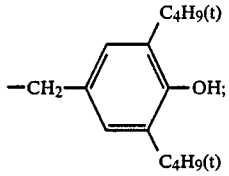

and $R_{10}$ represents a hydrogen atom, an alkyl group having from 1 to 12 carbon atoms or an acryloyl group;

(VII)

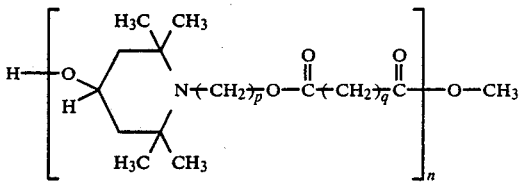

wherein p and q each is an integer of from 1 to 12; and n is an integer of from 2 to 50;

(VIII)

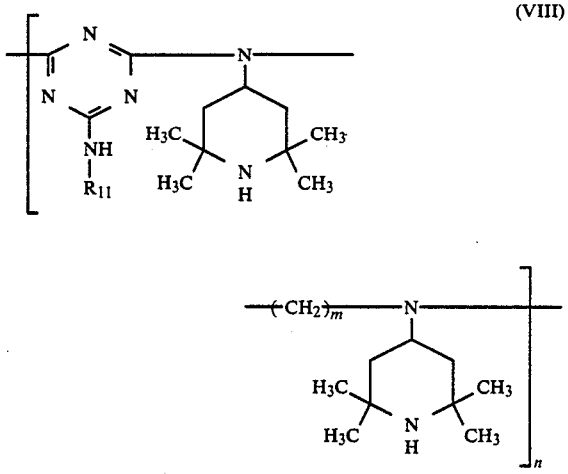

wherein $R_{11}$ represents a hydrogen atom, an alkyl group having from 1 to 18 carbon atoms, an aryl group having from 6 to 12 carbon atoms or an aralkyl group having from 7 to 12 carbon atoms; m is an integer of from 1 to 12; and n is an integer of from 2 to 10;

(IX)

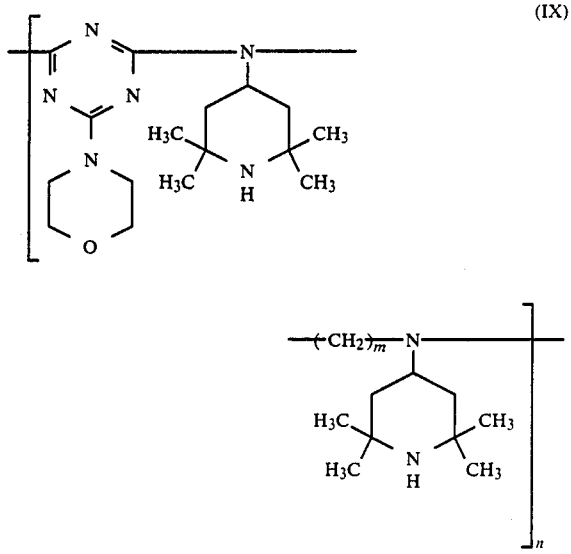

wherein m is an integer of from 1 to 12; and n is an integer of from 2 to 10; and (X)

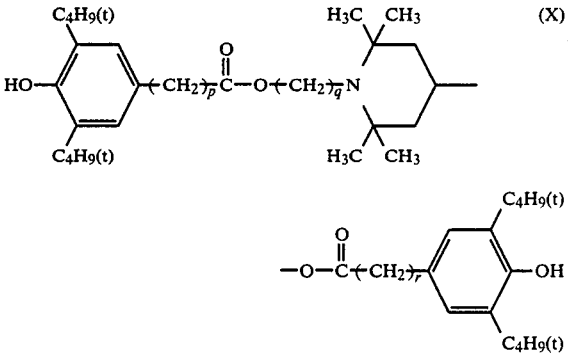

wherein p, q and r each is an integer of from 1 to 12; and additives comprising a natural or synthetic high-molecular weight compound selected from the group consisting of ketone resins, polyamide resins, maleic acid resins, phenolic resins, expoxy resins, alkyd resins, melamine resins, urea resins, polyvinyl alcohol, gelatin, and shellac, and a pigment.

2. A desensitizer composition as in claim 1, wherein said 2,2,6,6-tetramethylpiperidine derivative is incorporated into the desensitizer composition in an amount of from 0.1 to 40% by weight.

3. A desensitizer composition as in claim 1, wherein said 2,2,6,6-tetramethylpiperidine derivative is incorporated into the desensitizer composition in an amount of from 1 to 20% by weight.

4. A desensitizer composition as in claim 2, wherein said natural or synthetic high-molecular weight compound is incorporated into the desensitizer composition in an amount of from 5 to 25% by weight.

5. A desensitizer composition as in claim 2, wherein said pigment is incorporated into the desensitizer composition in an amount of from 0.3 to 40% by weight.

6. A desensitizer composition as in claim 1, coated onto a color developer substrate in an amount of from 1.5 to 6.0 g/m$^2$.

* * * * *